US005541373A

United States Patent [19]

Cheng

[11] Patent Number: 5,541,373

[45] Date of Patent: Jul. 30, 1996

[54] ACTIVE EXHAUST SILENCER

[75] Inventor: C. Raymond Cheng, Madison, Wis.

[73] Assignee: Digisonix, Inc., Middleton, Wis.

[21] Appl. No.: 301,124

[22] Filed: Sep. 6, 1994

[51] Int. Cl.[6] ..... F01N 1/06

[52] U.S. Cl. ..... 181/206; 381/71

[58] Field of Search ..... 181/206, 282; 381/71

[56] References Cited

U.S. PATENT DOCUMENTS

| | | | |
|---|---|---|---|
| 3,826,870 | 7/1974 | Wurm et al. . | |
| 4,359,136 | 11/1982 | Eriksson . | |
| 4,665,549 | 5/1987 | Eriksson et al. . | |
| 4,805,733 | 2/1989 | Kato et al. . | |
| 4,834,214 | 5/1989 | Feuling | 181/282 X |
| 5,025,889 | 6/1991 | Lockwood et al. . | |
| 5,044,464 | 9/1991 | Bremigan . | |
| 5,060,271 | 10/1991 | Geddes . | |
| 5,063,598 | 11/1991 | Geddes . | |
| 5,088,575 | 2/1992 | Eriksson . | |
| 5,097,923 | 3/1992 | Ziegler et al. . | |
| 5,119,902 | 6/1992 | Geddes . | |
| 5,229,556 | 6/1993 | Geddes . | |
| 5,233,137 | 8/1993 | Geddes . | |
| 5,272,286 | 12/1993 | Cain et al. . | |
| 5,325,438 | 6/1994 | Browning et al. . | |
| 5,336,856 | 8/1994 | Krider et al. | 181/206 |
| 5,418,873 | 5/1995 | Eriksson | 381/71 |

FOREIGN PATENT DOCUMENTS

| | | |
|---|---|---|
| 1357330 | 6/1974 | United Kingdom . |

*Primary Examiner*—Khanh Dang

*Attorney, Agent, or Firm*—Andrus, Sceales, Starke & Sawall

[57] ABSTRACT

An active silencer for a vehicle exhaust system that has a low profile so that it can be hung underneath the vehicle in a conventional manner without altering the vehicle. The silencer has a chamber isolated from the exhaust flow in which one or more speakers are mounted side-by-side. The speakers face downwards and share a common tuning chamber within the isolated chamber. The tuning chamber is ported to a mixing chamber where the canceling acoustic waves mix with noise from the exhaust flow before the exhaust noise exits to the atmosphere.

17 Claims, 2 Drawing Sheets

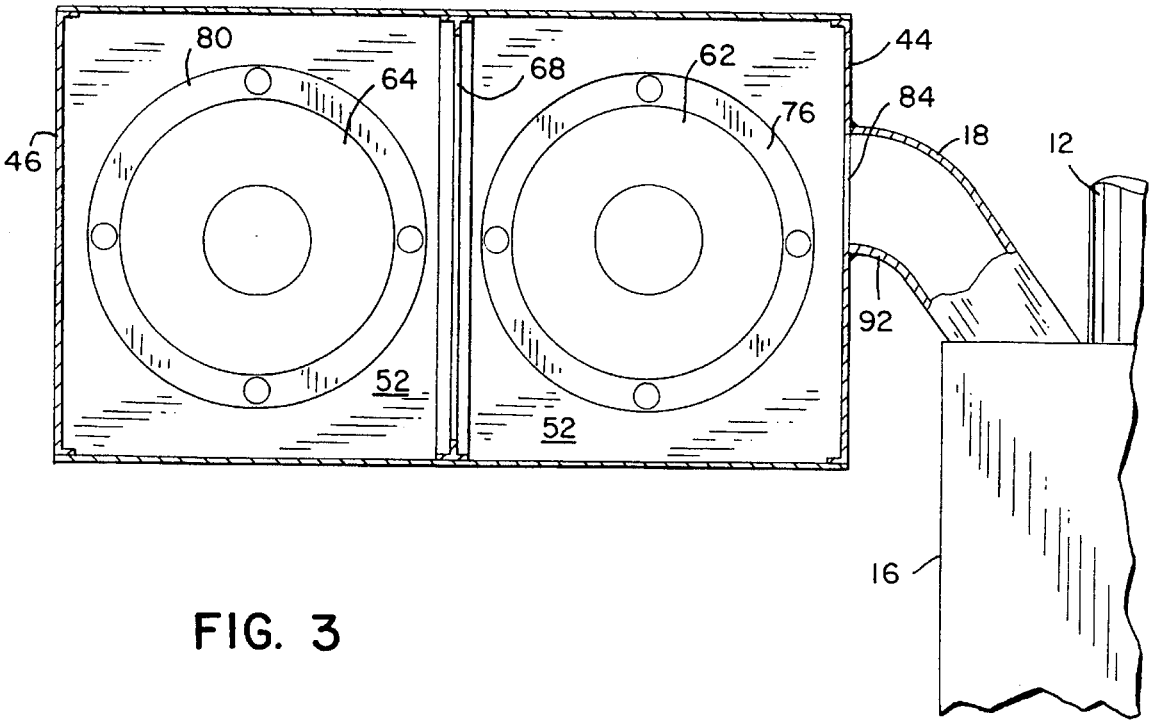
FIG. 3
FIG. 5
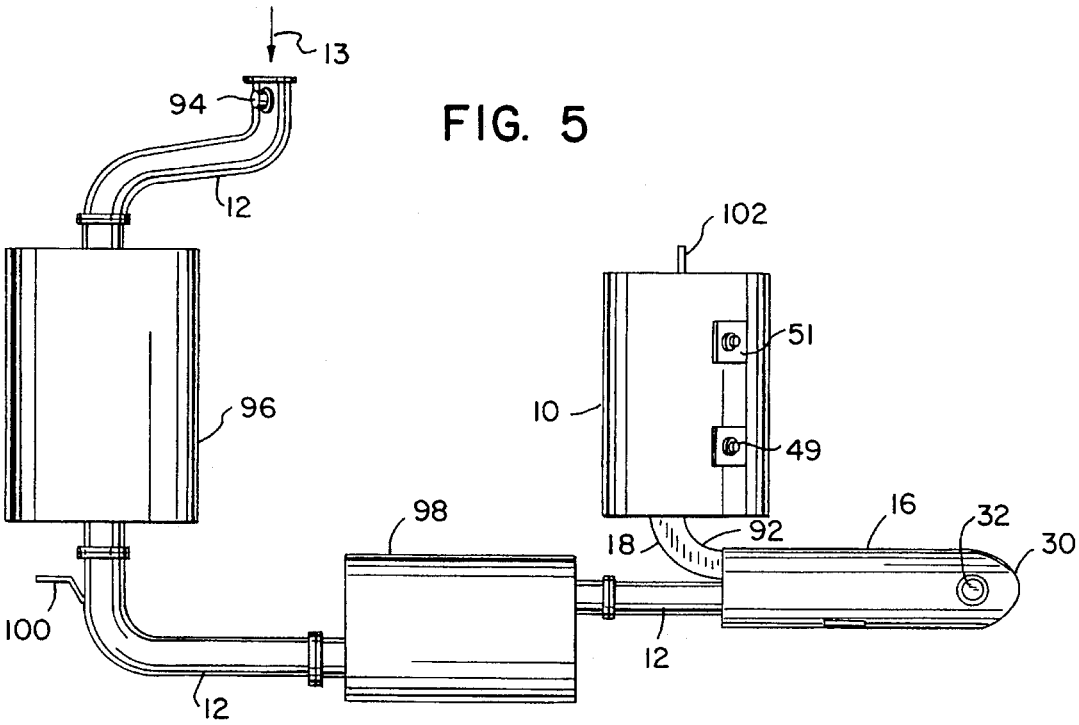

ACTIVE EXHAUST SILENCER

FIELD OF THE INVENTION

The invention relates to active silencing systems, and in particular, to an active silencer for vehicle exhaust systems.

BACKGROUND OF THE INVENTION

Using an active silencer in a vehicle exhaust system can improve engine efficiency because of reduced exhaust back pressure. One problem with active silencers is that active silencers are often bulky and their use requires the vehicle to be specifically designed or retrofitted to accommodate the active silencer. The invention is an active silencer and a method of making the same that allows for compact, low-profile construction, thus substantially eliminating this problem.

In general, active silencers inject a canceling acoustic wave to destructively interfere with and cancel an input acoustic wave. It is typical to sense the input acoustic wave with an input microphone and the output acoustic wave with an error microphone. The input microphone supplies an input or feedforward signal to an electronic controller, and the error microphone supplies an error or feedback signal to the electronic controller. The electronic controller, in turn, supplies a correction signal to one or more loudspeakers that generate a canceling acoustic wave to destructively interfere with an input acoustic wave such that the output acoustic wave at the error microphone is zero (or at least reduced).

In a vehicle exhaust system, it is desirable to keep the speakers in an active silencer protected from the hot exhaust gases to prevent premature deterioration. One way of providing such isolation is disclosed by Bremigan in U.S. Pat. No. 5,044,464 in which two speakers are located in a chamber away from the main exhaust flow. The canceling acoustic waves are directed from the chamber to the exhaust flow. In U.S. Pat. Nos. 5,233,137 and 5,229,556, Geddes discloses a system isolating the speakers from the exhaust flow wherein a tuned chamber is ported to the exhaust flow. This system has the advantage of improving speaker efficiency over the frequency band width appropriate for the application.

In an exhaust system, it is also desirable that the active silencer does not significantly shake or vibrate during operation. Such shaking or vibration can be to a large extent due to movement of the speakers. The Bremigan and Geddes patents show a pair of speakers mounted face-to-face so the axial load of the speakers cancel one another thus eliminating structure vibrations by the speakers. However, the face-to-face speaker arrangement adds considerable bulk to the design. In particular, the dimensions of a system using a face-to-face arrangement is too tall to fit in a conventional automobile without retrofitting.

Therefore, it is desirable to have a low-profile active exhaust silencer in which the speakers are isolated from the exhaust flow.

SUMMARY OF THE INVENTION

The invention is an active silencer that can have a low-profile for canceling noise from an exhaust pipe, and a method of making the same. The active silencer has a chamber containing one or more canceling loudspeakers that are isolated from the exhaust flow. The chamber preferably has a low-profile (i.e. an aspect ratio of less than one meaning that the height of the chamber is less than the width of the chamber). Such a low-profile chamber can be hung from a conventional automobile in the same manner as a conventional passive muffler.

In the preferred embodiment, the silencer chamber is defined by an outer wall, and a front end wall and a rear end wall. A partition separates the chamber into a top volume and a bottom volume. The partition spans from the front end wall to the rear end wall and has a front and a rear speaker hole. Two loudspeakers are mounted side-by-side to the partition through the speaker holes. The speaker diaphragms point downward and are in acoustic communication with the bottom volume in the chamber. The bottom volume of the chamber is preferably a tuning chamber shared by both speakers. A port from the bottom volume through the front end wall provides a path for the canceling acoustic wave to the exhaust flow. The exhaust flow and the canceling acoustic wave can be mixed in a mixing chamber that has an end open to the atmosphere. An error microphone can be located in the mixing chamber.

It is preferred that the outer wall be an oval-shaped cylindrical wall and that the front and the rear end walls be oval-shaped, and substantially flat and perpendicular to the outer wall. Reinforcement flanges should be used to reinforce the outer cylindrical wall and also to reinforce the partition. The partition can also be reinforced by bending the peripheral edges of the partition before attaching the partition to the outer and end walls. This construction provides strength which allows the speakers to be mounted side-by-side facing the same downward direction, thus reducing the height of the chamber.

Also, the partition can be positioned low in the chamber so that the top volume (i.e. the speaker back volume) is larger than the bottom volume (i.e. the tuning chamber). In addition, when mounting the speakers to the partition, spacers can be used to position the speakers lower in the chamber. These two features also help reduce the height of the chamber.

In another aspect, the invention is a method for making an active silencer as described above. The method provides an efficient means for making an active silencer. The method is possible in part because the complexity of the silencer is minimized by mounting one or more speakers side-by-side to share a common top and bottom volume.

It can thus be appreciated that the invention allows for a low-profile construction of an active silencer, while at the same time keeps the speakers isolated from the exhaust flow. Other objects and advantages of the present invention will be apparent from the following detailed description when considered in conjunction with the accompanied drawings.

BRIEF DESCRIPTION OF THE DRAWINGS

FIG. 3 is a top cross-sectional view taken along line 3—3 in FIG. 2.

FIG. 5 is a schematic top view of an exhaust system employing the invention.

DETAILED DESCRIPTION OF PREFERRED EMBODIMENT

Figure 1:
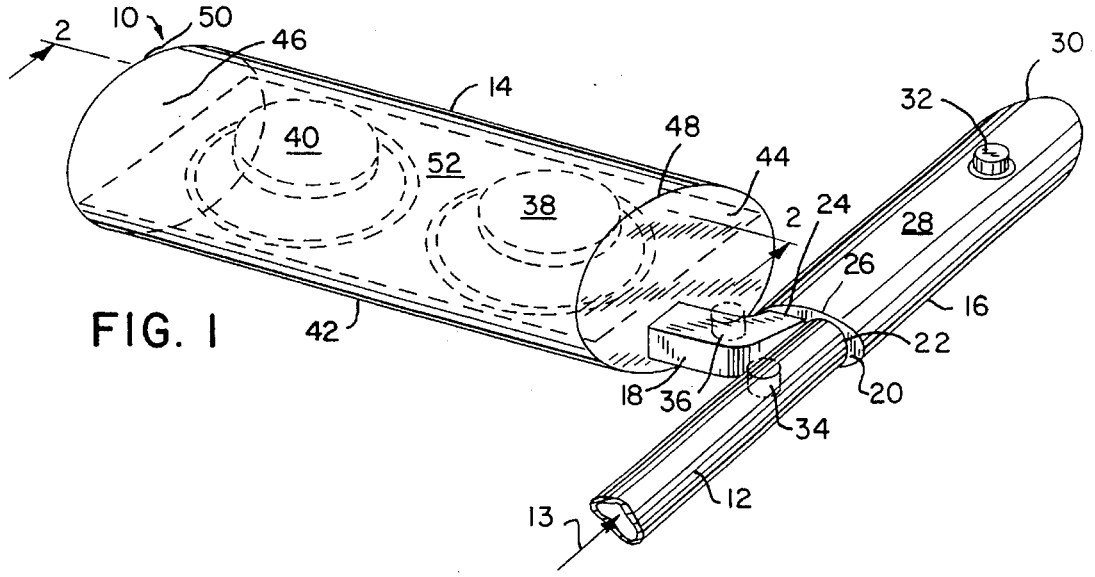
FIG. 1 is a perspective view of an active silencer in accordance with the invention.
Figure 2:
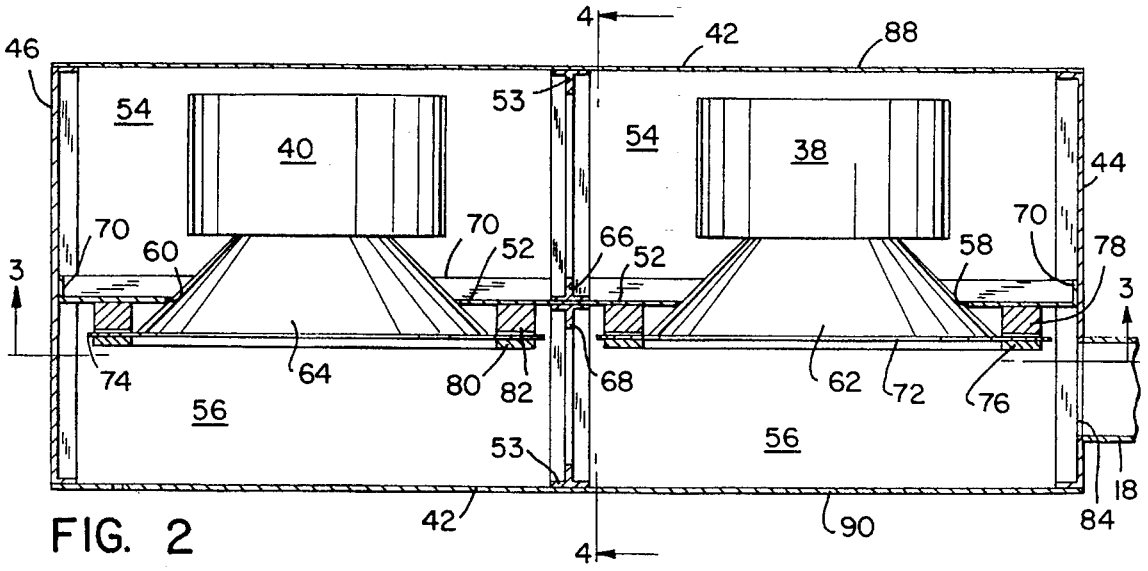
FIG. 2 is a longitudinal cross-sectional view taken along line 2—2 in FIG. 1.

Referring to FIGS. 1–4, an active silencer 10 attenuates sound propagating through exhaust pipe 12. Exhaust gas flows through exhaust pipe 12 in the direction of arrow 13 and engine noise also propagates through exhaust pipe 12 in the direction of arrow 13. A canceling acoustic wave is generated in an isolated chamber 14 and communicates with a mixing chamber 16 through a port 18. The canceling acoustic wave mixes with engine noise in the mixing chamber 16 to destructively interfere with the engine noise.

The mixing chamber 16 has an inlet end with an upstream wall 20. The upstream wall 20 has an exhaust pipe opening 22 and a port opening 24.

Since the port 18 is connected next to the exhaust pipe 12 on the upstream wall 20 of the mixing chamber 16, exhaust gas does not in general flow back through the port 18 into the isolated chamber 14. The exhaust pipe 12 is attached to the upstream wall 20 around the exhaust pipe hole 22. The port 18 is connected to the upstream wall 20 around the port opening 24. The upstream wall 22 has a peripheral edge 26 in the shape of an oval. The mixing chamber 16 has a generally oval-shaped cylindrical wall 28 that is attached to the peripheral edge 26 of the upstream wall 20. It is preferred that the cross-section of the oval-shaped mixing chamber 16 be as small as reasonable to accommodate openings 22 and 24 in the upstream wall 20 of the mixing chamber 16. It is also preferred that the mixing chamber 16 be long enough so that the canceling acoustic waves can completely mix with the engine noise before exiting through an outlet 30 of the mixing chamber 16.

An error microphone 32 is preferably located within the mixing chamber 16 approximately 3" from the outlet 30. However, the error microphone 32 can be located anywhere towards the outlet 30 of mixing chamber 16. The preferred system is thus an "in pipe" cancellation system which has the advantage of eliminating the effects of non-exhaust noises from the surrounding atmosphere. Alternatively, indirect error sensing can be used such as is disclosed in Eriksson, U.S. patent application Ser. No. 08/118,877, filed on Sep. 9, 1993, now U.S. Pat. No. 5,418,873, which is incorporated herein by reference. Such an indirect error sensing scheme would include an error microphone 34 (shown in phantom in FIG. 1) in the exhaust pipe 12. The indirect error sensing system may also include another error microphone 36 (shown in phantom in FIG. 1) in port 18. If such an indirect error sensing scheme is used, it may be possible to eliminate the mixing chamber 16 and convert the system to an "out of pipe" cancellation system where the canceling acoustic wave from the port 18 mixes with the noise from the exhaust pipe 12 in the atmosphere.

A front speaker 38 and a rear speaker 40 are located within the isolated chamber 14 and generate the canceling acoustic wave. Since exhaust does not flow back through the port 18 into the isolated chamber 14, the speakers 38 and 40 inside the chamber 14 are virtually free from direct exposure to exhaust gas. This means that no insulating scheme is needed to shield the speakers against heat or corrosive gases inside the enclosure. The speakers 38 and 40 both face downwards in the isolated chamber 14, and this helps prevent moisture from accumulating in the speakers.

The isolated chamber 14 is an enclosing wall structure with an outer wall 42, a front end wall 44 and a rear end wall 46. The outer wall 42 is an oval-shaped cylindrical wall having a front edge 48 and a rear edge 50. The outer wall 42 has a front electrical connector 49 and a rear electrical connector 51 through the upper portion of the wall 42. Power is provided to the speakers 38 and 40 from an electrical controller via the electrical connector 49 and 51.

Figure 4:
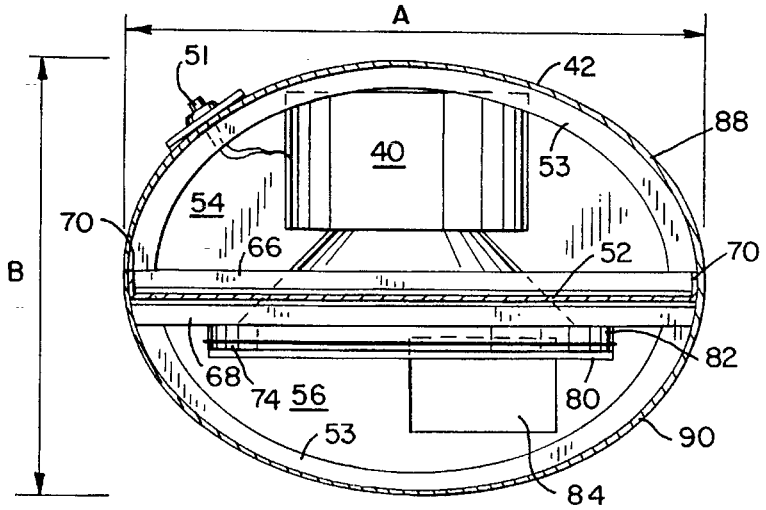
FIG. 4 is a cross-sectional view taken along line 4—4 in FIG. 2.

The oval-shaped cylindrical outer wall 42 preferably has a height of 6.5" (represented as B in FIG. 4) and a width of 8" (represented as A in FIG. 4). The chamber 14 thus has a preferred aspect ratio of 6.5/8. Such a structure has a low profile and can be used on many conventional automobiles without altering the automobile. The front 44 and rear 46 end walls are also oval-shaped with corresponding dimensions. The front end wall 44 is attached to the front edge 48 of the oval-shaped cylindrical outer wall 42. The rear end plate 46 is attached to the rear edge 50 of the oval-shaped outer cylindrical wall 42.

A reinforcement flange 53 is integral with the inside surface of the outer wall 42. The reinforcement flange 53 extends around the inside circumference of the outer wall 42, and is substantially equal distance between the front 44 and the rear 46 end walls.

A partition 52 separates the isolated chamber 14 into a top volume 54 and a bottom volume 56. The top volume 54 is preferably 2.26 liters. The bottom volume 56 is preferably 1.8 liters. The partition 52 is located in the lower part of the chamber 14. The partition 52 has a front speaker hole 58 and a rear speaker hole 60 therethrough. Front speaker 38 is mounted to the partition 52 through speaker hole 58. The rear speaker 40 is mounted to the partition 52 through hole 60. The front speaker 38 has a diaphragm 62 and the rear speaker 40 has a diaphragm 64. The diaphragms 62 and 64 are in acoustic communication with the bottom volume 56. When mounted to the partition 52, the speakers 38 and 40 reside mostly in the top volume 54, and are relatively close to the outer wall 42.

An upper flange 66 and a lower flange 68 reinforce the partition 52. The upper flange 66 is integral with the partition 52 and extends into the top volume 54. The upper partition flange 66 is located between the front 58 and the rear 60 speaker holes. The lower partition flange 68 is similar to the upper partition flange 66 except the lower partition flange 68 extends into the lower volume 56.

The partition 52 has a peripheral edge 70 which is bent upwards at a 90° angle so that the peripheral edge 70 has an upward facing flange of about ¼". The bend of the peripheral edge 70 facilitates attachment of the partition 52 to the outer wall 42 and the end walls 44 and 46, and also further reinforces the partition 52.

Each speaker 38 and 40 has a speaker basket 72 and 74, respectively, that supports the speaker diaphragm. Each speaker is mounted to the partition 52 by mounting the speaker basket to the partition 52. In particular, front speaker 38 is mounted to the partition 52 by attaching the basket 72 to the partition 52 with nuts and bolts. A securing ring 76 can be used between the nuts and the basket 72 to provide even support for the basket 72. Additionally, a front spacer 78 can be placed between the partition 52 and the basket 72. Likewise, rear speaker 40 can be mounted to partition 52 by screwing the basket 74 on the rear speaker 40 to the partition 52 with the user of a security ring 80 and a rear spacer 82. The use of the spacers 78 and 82 allows the speakers 38 and 40 to be mounted lower in the isolated chamber 14, thus further reducing the height of the chamber 14.

The front end wall 44 has a port hole 84 that opens into the bottom volume 56. The port 18 is attached to the front end wall 44 around the port hole 84 so that a canceling acoustic wave generated by the speakers 38 and 40 can propagate from the bottom volume 56 through the port 18 into the mixing chamber 16. The port is preferably sized in length and width so that the combination of the bottom volume 56 and the port 18 respond as a ported tuning chamber which distributes speaker power within the proper frequency band for normal operation.

Referring to FIG. 5, the active silencer 10 can be used in conjunction with one or more passive silencers in an exhaust system. Exhaust gas flows from the engine in the direction of arrow 13 through exhaust pipe 12. An input microphone 94 can be located before passive silencers 96 and 98 along the exhaust pipe 12. The entire system shown in FIG. 5 can be hung underneath a vehicle with hangers 100 and 102 in much the same fashion as a conventional passive system is hung.

The microphones used are preferably high temperature microphones. An electronic controller controls the output of the speakers 38 and 40 in the active silencer 10 in response to the microphone signals. The electronic controller can be located in the trunk of the car. It is preferred that the weights in the electronic controller for the adaptive analysis be preloaded to eliminate the need for initial modeling every time the engine is started. Also, it is preferred that the active system be wired to the ignition circuit of the automobile.

The preferred method of fabricating the active silencer 10 is now described. A flat sheet of 13.5" by 15.5" 16 gauge stainless steel is used to make an upper portion 88 of the oval-shaped cylindrical wall 42. Two 1" holes are drilled or cut out of the 13.5" by 15.5" sheet for electrical connectors 49 and 51, one hole for each speaker 38 and 40. The sheet is then rolled to form an upper portion of an oval-shaped cylinder 88. Note that the upper portion 88 of the oval-shaped cylinder is larger than a lower portion 90 of the oval-shaped cylinder 42. The reinforcement flanges 53 for the upper portion 88 and the lower portion 90 of the cylindrical wall 42 are preferably made from 16 gauge stainless steel and are either prefabricated or made by welding two strips of the steel together in a tee. A reinforcement flange 53 is welded to the upper portion 88 of the oval-shaped cylindrical wall 42 to reinforce the upper portion of the cylinder.

The bottom portion 90 of the oval-shaped cylindrical wall 42 is made from a 10.5"×15.5" sheet of 16 gauge stainless steel. A drain hole is drilled in the sheet, and the sheet is rolled to fit the oval-shaped end walls 44 and 46. The flange 53 is welded to the bottom portion 90 of the oval-shaped wall 42.

The front end wall 44 and the rear end wall 46 are preferably 16 gauge stainless steel, oval-shaped, and normally prefabricated. The front end wall 44 and the rear end wall 46 are welded to the upper portion 88 of the oval-shaped cylindrical wall 42. The port hole 84 is cut into the lower portion of the front end wall 44 before the front end wall 44 is welded to the upper portion 88 of the oval-shaped cylindrical wall 42.

The port 18 is fabricated preferably from 16 gauge stainless steel walls welded together. The port 18 preferably has a rectangular cross section with about a 1.57" height and a 1.97" width. The port 18 is bent along its axis between the isolated chamber 14 and the mixing chamber 16 at about a 45° angle . The bend 92 allows the isolated chamber 14 to be placed in a convenient location.

The partition 52 is preferably made from an 8.75" by 15" flat sheet of 16 gauge stainless steel. The speaker holes 58 and 60 and the bolt holes for mounting the speakers 38 and 40 are cut into the sheet. The peripheral edge 70 of the partition sheet is bent upward 90° ¼" from the edge 70 to add strength and provide weld area. Five ¼" weld holes are evenly spaced between the speaker holes 58 and 60 and are aligned parallel to the front 44 and end 46 walls. Bolts are welded to the partition 52 through the bolt holes so that the speakers 38 and 40 can be mounted after welding is completed. The upper partition flange 66 and the lower partition flange 68 are welded to the partition 52 through the evenly spaced plug holes, and are also welded along each side of the flange.

The speaker 38 and 40 are mounted to the partition 52 by attaching the speaker baskets 74 and 72 to the bolts using nuts, spacers and securing rings as described before. The speakers 38 and 40 are mounted side by side and face downwards. The partition 52 is welded to the front 44 and rear 46 end walls and the upper portion 88 of the outer oval-shaped cylindrical wall 42. The lower portion 90 of the oval-shaped cylindrical wall is welded to the front 44 and rear 46 end walls and the bottom edge of the upper portion 88 of the oval-shaped cylindrical wall 42.

It can be appreciated that the front 38 and rear 40 speakers share the common top 54 and bottom 56 volumes, and this simplifies the complexity of the active silencer 10, and allows efficient fabrication of an active silencer that has a low-profile and is structurally stable.

It is recognized that various equivalents, alternatives and modifications are possible and should be considered within the scope of the claims.

We claim:

1. An active silencer for canceling noise from an exhaust pipe comprising:

a chamber having an enclosing wall structure with an outer wall, a front end wall and a rear end wall;

a partition separating the chamber into a top volume and a bottom volume, the partition spanning from the front end wall to the rear end wall and having a speaker hole therein;

a loudspeaker mounted to the partition through the speaker hole so that a diaphragm of the speaker is in acoustic communication with the bottom volume; and a port from the bottom volume through the front end wall for communicating with noise from the exhaust pipe.

2. An active silencer as recited in claim 1 wherein the bottom volume is a tuning chamber.

3. An active silencer as recited in claim 1 wherein the partition has a second speaker hole therein, and the active silencer further comprises a second loud-speaker mounted to the partition through the second speaker hole so that a diaphragm of the second speaker is in acoustic communication with the bottom volume.

4. An active silencer as recited in claim 3 wherein the bottom volume is a tuning chamber shared by both speakers.

5. An active silencer as recited in claim 1 wherein the enclosing wall structure has an outer oval-shaped cylindrical wall, and the front and rear end walls are substantially flat and perpendicular to the outer wall.

6. An active silencer as recited in claim 1 further comprising a reinforcement flange integral with the outer wall, and extending inwardly from the outer wall around the inner surface of the outer wall, the reinforcement flange being located substantially equal distance between the front and rear end walls.

7. An active silencer as recited in claim 3 further comprising an upper partition flange integral with the partition and extending into the top volume, the upper partition flange being located between the speaker holes in the partition.

8. An active silencer as recited in claim 3 further comprising a lower partition flange integral with the partition and extending into the lower volume, the lower partition flange being located between the speaker holes in the partition.

9. An active silencer as recited in claim 1 wherein the partition has a peripheral edge that is bent and is attached to the enclosing wall structure.

10. An active silencer as recited in claim 1 further comprising a speaker mounting spacer wherein the speaker is mounted to the partition by fastening a basket of the speaker to the partition with the spacer therebetween.

11. An active silencer as recited in claim 10 further comprising a speaker securing ring wherein the speaker is fastened to the partition by fastening the speaker securing ring to the partition with the speaker basket and the spacer therebetween.

12. An active silencer as recited in claim 1 wherein the outer wall has a drain hole in a part of the outer wall that encloses the bottom volume.

13. An active silencer as recited in claim 1 further comprising a mixing chamber having an inlet end that receives the port and the exhaust pipe, and an outlet end that is open to the atmosphere.

14. An active silencer as recited in claim 3 further comprising an error microphone located in the mixing chamber.

15. An active silencer as recited in claim 1 further comprising a first microphone located in the port and a second microphone located in the exhaust pipe.

16. An active silencer as recited in claim 1 wherein the partition is positioned so that the top volume is larger than the bottom volume.

17. An active silencer for canceling noise from an exhaust pipe comprising:

a chamber having an enclosing wall structure with an outer wall, a first end wall and a second end wall;

a partition separating the chamber into a first volume and a second volume, the partition spanning from the first end wall to the second end wall and having a speaker hole therein;

a loudspeaker mounted to the partition through the speaker hole so that a diaphragm of the speaker is in acoustic communication with the second volume; and a port from the second volume through the first end wall for communicating with noise from the exhaust pipe.

* * * * *